United States Patent [19]

Canterberry et al.

[11] Patent Number: 5,069,133

[45] Date of Patent: Dec. 3, 1991

[54] ELASTOMER-CONTAINING CASINGS FOR PROPELLANTS

[75] Inventors: J. B. Canterberry, Auburn Hills, Mich.; Terry A. Murray, Quincy, Fla.

[73] Assignee: Olin Corporation, Cheshire, Conn.

[21] Appl. No.: 576,576

[22] Filed: Aug. 31, 1990

[51] Int. Cl.[5] ..... F42B 3/00; C06D 1/08

[52] U.S. Cl. ..... 102/332; 102/331; 86/20.12; 264/3.2

[58] Field of Search ..... 86/20.12; 102/331, 332; 264/3.2

[56] References Cited

U.S. PATENT DOCUMENTS

| | | | |
|---|---|---|---|
| 3,706,280 | 12/1982 | Bobinski et al. | 102/43 |
| 3,770,563 | 11/1973 | Bobinski et al. | 102/38 X |
| 4,034,676 | 7/1977 | Daume | 102/103 |
| 4,232,608 | 11/1980 | Wrightson | 102/103 |
| 4,429,634 | 2/1984 | Byrd et al. | 102/290 |
| 4,601,862 | 7/1986 | Byrd et al. | 269/3.1 |
| 4,950,342 | 8/1990 | Canterberry | 179/10 |

*Primary Examiner*—Peter A. Nelson

*Attorney, Agent, or Firm*—Dale Lynn Carlson

[57] ABSTRACT

The present invention relates to a process for producing an encased propellant which comprises overwrapping at least one charge of propellant with an elastomeric coating composition to produce the desired encased propellant. The process is suitably effected by molding, casting, dipping, or otherwise applying the coating composition to the charge of propellant. The process and composition of the present invention is expected to be useful in the production of encased tank ammunition, and the like.

8 Claims, No Drawings

ELASTOMER-CONTAINING CASINGS FOR PROPELLANTS

FIELD OF THE INVENTION

This invention relates generally to propellants, and, more specifically, to combustible elastomeric containers for propellants.

BACKGROUND OF THE INVENTION

Combustible containers for propellant compositions in commercial use at the present time typically are fabricated by a felting process utilizing paper or cardboard materials. An illustrative container material is KRAFT paper employing 13.4 percent nitrogen-containing nitrocellulose, and the paper can be coated, impregnated or dipped to incorporate various optional additives as desired.

Among the disadvantages of prior art combustible, containers is the tendency to leave a burn residue in the combustion chamber of guns, as well as to be more water permeable during propellant storage than might be desired. Accordingly, new containers which are cleaner burning during use and which provide enhanced water impermeability during propellant storage would be highly desired by the propellant manufacturing community.

SUMMARY OF THE INVENTION

In one aspect, the present invention relates to a process for producing an encased propellant which comprises overwrapping at least one charge of propellant with an elastomeric coating composition. Preferably the coating composition is free of any cellulosic compound.

In another aspect, the present invention relates to an encased propellant comprising a propellant charge overwrapped with an elastomeric coating composition.

These and other aspects of the present invention will become apparent upon reading the following detailed description of the invention.

DETAILED DESCRIPTION OF THE INVENTION

The propellant suitable for encasing in a container within the scope of the present invention is suitably a high energy material such as, for example, RDX, NTO, TNT, HMX, TAGN, nitroguanidine, nitrocellulose, nitroglycerine and ammonium nitrate. Nitrocellulose propellants may be single-base or multi-base, as described for example in U.S. Pat. No. 4,950,342, and these materials are commercially available as Olin Corporation's Ball Powder®. Energetic plasticizers are suitably employed in the fabrication of the propellant, including, for example, nitroglycerine, diethylene glycol dinitrate, butane triol trinitrate, and the like.

The present invention is based upon the discovery that elastomeric compositions can be fabricated to provide a desired degree of toughness to withstand shock and abrasion during handling, as well as to provide desired water impermeability, and also be clean burning during use as a propellant casing. Although not wishing to be limited, the encased propellants of the present invention are expected to be useful in the form of tank ammunition, and the like.

The casings useful in the present invention can be fabricated to contain the desired elastomeric composition, alone or in combination with other additives such as oxidizers, e.g., potassium nitrate. The elastomeric composition is appropriately fabricated using a thermoplastic or thermosetting polymer. Suitable polymers include polyurethanes, polyacrylates, phenolics, and combinations thereof, and the like. The preferred polymers are the polyurethanes.

The casing utilized in the present invention is suitably fabricated to overwrap the propellant using any of the well-known coating techniques including, for example, casting, reaction injection molding, dipping, spraying, or the like. A single layer or a multi-layer casing is suitably employed as desired. For example, a two-layer casing can be utilized to provide specific characteristics based upon the advantageous properties of each of the layers. As an illustration, a thermoplastic polyethylene overwrap or a spray coating of a butyl rubber can be used to provide an inner-layer moisture barrier to the casing, and this can be used in combination with a thermosetting polyurethane overwrap to provide a tough outer layer to the casing.

The casing is usefully fabricated using optional additives, including oxidizers, burn rate modifiers, stabilizers, fillers, and the like, as desired in order to enhance the desired toughness, combustion profile, or other desired characteristics of the casing. The optional additives are generally present in a total amount of less than 50 weight percent based upon the weight of the casing. The casing is preferably free of any cellulosic compound in order to provide a clean burning casing.

In the fabrication of the preferred class of polyurethane casings, any desired polyol may be employed as desired. The various classes of suitable polyols are well-known, and these include polyether polyols, polyester polyols, polymer/polyols, hydroxy-terminated polyisocyanate prepolymers, and the like.

Any desired polyisocyanate is also suitably employed in the fabrication of polyurethane casings, including aromatic polyisocyanates such as tolulene diisocyanate ("TDI"), methylene diphenylene diisocyanate ("MDI"), as well as aliphatic polyisocyanates. Suitable aliphatic isocyanates include those identified by the empirical structural formula:

$$R(NCO)_2$$

wherein R is a divalent aliphatic group having between 2 and 20 carbon atoms; a divalent cycloalkyl group having between 3 and 9 carbon atoms; or a divalent alkylcycloalkyl having between 5 and 20 carbon atoms. Typical examples of suitable organic diisocyanates include aliphatic diisocyanates such as: ethylene, trimethylene, tetramethylene, pentamethylene, hexamethylene, heptamethylene, up to icosamethylene; 1,2-propylene, 1,3-butylene, 2,3-butylene, 1,3-butylene, ethylidine, and butylidine diisocyanates; cycloalkylene diisocyanates such as 1,3-cyclopentene, 1,4-cyclohexene, 1,2-cyclohexene diisocyanate; cycloalkane diisocyanates such as cyclopentyl, cyclohexyl, and cycloheptyl diisocyanate; alkylcycloalkyl diisocyanates such as methylcyclopentyl, methylcyclohxyl, dimethylcyclohexyl, isophorone diisocyanate.

The duration and temperature of the coating process and the amount of the applied deterrent polymer are variable within the given limits depending upon the exact composition of the nitrocellulose propellant composition and the end use to which it is applied.

The following examples are intended to illustrate, but in no way limit the scope of, the present invention. All patents referred to herein are incorporated herein by reference in their entirety.

EXAMPLE 1

Fabrication of a Molded Casing Using Cast Polyurethane

A mixture was made of DESMOPHENE 1150, a branched polyol with ether and ester linkages, which is a product of Mobay Chemical, and MONDUR MRS5 polyisocyanate in a weight ratio of 2:1. This mixture was cast around a cylinder of compacted Ball Powder ® in a mold which is the diameter of the particular gun chamber for which the change is desired. The mold with the cast polymer was cured in an oven overnight to give the final encased cartridge.

As an alternative, the compacted Ball Powder ® may be, if desired, coated first with an inert material such as butyl rubber, impregnated cheesecloth or some similar material. The mold is typically treated with a mold-release agent for ease of disengagement. If desired, the urethane mixture may contain an oxidizer such as potassium nitrate, RDX or some other material to aid in complete combustion of the cartridge material.

EXAMPLE 2

Preparation of Another Casing Composition

A prepolymer was made by heating a mixture of 2.44 g 1,1'-methylenebis (isocyanatobenzene) (MDI) and 453.1 g POLY -G 20-56 (A -2000 molecular weight polyether diol from Olin Corp.) to 80° C. for 3 hours under a nitrogen atmosphere. The free isocyanate was determined to be 8.78% by back titration of a dibutylamine/prepolymer mixture with 0.1N hydrochloric acid.

The prepolymer (151.2 g) was degassed under vacuum with stirring. The system was flushed with nitrogen and butanediol (BDO) (13.82 g) added. The mixture was evacuated and stirred for 10 minutes. The system was flushed with nitrogen and the mixture poured out into a mold and placed in a 110° C. oven overnight (16 hours) to form a molded casing.

EXAMPLE 3

Fabrication of Another Casing Composition

Potassium nitrate ($KNO_3$) was ground to a fine powder using a mortar and pestle. The $KNO_3$ was dried in an oven at 60° C. The prepolymer of Example 2 (103.5 g) and the dried $KNO_3$ (37.67 g) were placed into the reactor and degassed under vacuum with stirring. The system was flushed with nitrogen and butanediol (BDO) 9.46 g) was added. The mixture was evacuated and stirred for 10 minutes. The system was flushed with nitrogen and the mixture poured out into a mold and placed in a 110° C. oven overnight (16 hours) to form a molded casing.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

What is claimed is:

1. A process for producing an encased propellant which comprises overwrapping in the presence of the propellant at least one charge of propellant with an elastomeric coating composition free of any cellulosic compound.

2. The process of claim 1 wherein said overwrapping is effected by molding, spray casting, dipping, or a combination thereof, in order to form said encased propellant.

3. The process of claim 1 wherein said overwrapping is effected by in situ reacting a polyol with a polyisocyanate in the presence of said propellant to form a polyurethane casing around said propellant.

4. The process of claim 3 wherein said in situ reaction is effected by reaction injection molding at an elevated pressure.

5. The process of claim 1 wherein said elastomeric coating composition additionally contains an additive selected from the group consisting of oxidizers, burn rate modifiers, stabilizers, and fillers.

6. An encased propellant comprising a propellant charge overwrapped in the presence of the propellant with an elastomeric coating composition free of any cellulosic compound.

7. The composition of claim 6 wherein said elastomeric coating composition composition comprises a polyurethane.

8. The composition of claim 6 wherein said propellant charge is a high energy material selected from the group consisting of RDX, NTO, TNT, HMX, TAGN, nitroguanidine, nitrocellulose, nitroglycerine, ammonium nitrate, and combinations thereof.

* * * * *